United States Patent [19]

Schepis

[11] Patent Number: 4,611,610

[45] Date of Patent: Sep. 16, 1986

[54] HAIR CURLING UNITS AND THEIR PRODUCTION

[76] Inventor: Nunziato Schepis, 34 Charles River Rd., Watertown, Mass. 02172

[21] Appl. No.: 719,514

[22] Filed: Apr. 3, 1985

[51] Int. Cl.[4] ..... A01D 4/14

[52] U.S. Cl. ..... 132/39; 132/33 R

[58] Field of Search ..... 132/7, 39, 33, 42, 40

[56] References Cited

U.S. PATENT DOCUMENTS

| | | | |
|---|---|---|---|
| 3,056,413 | 4/1960 | Unger | 132/42 R |
| 3,538,925 | 11/1970 | Riener | 132/39 |
| 3,545,457 | 12/1970 | Schepis | 132/13 |

*Primary Examiner*—Robert Peshock

[57] ABSTRACT

Hair curling units to be formed into a roll or to be wrapped about a member, in either case to have tresses wound about it, have two interconnected walls of flexible paper backed aluminum foil. The aluminum foil sides of the walls are the interior surfaces of the unit and the aluminum foil side of at least one wall has a dehydrated exothermic coat consisting of nitric acid and mercury partly reacted with the aluminum foil and bonded thereto. The walls may be unitary or separate blanks and in either case marginal portions remain unconnected to enable the exothermic material to be easily moistened.

6 Claims, 7 Drawing Figures

HAIR CURLING UNITS AND THEIR PRODUCTION

BACKGROUND OF THE INVENTION

It is well established that hair can be curled utilizing heat resulting from the contact of moistened exothermic materials with aluminum foil.

By way of example, hair curling packages in accordance with U.S. Pat. No. 3,545,457 are sealed envelopes with are sufficiently flexible to be formed into rolls about which tresses may be wound. Each envelope consists of outer, water repellant layers or sides with an inner, aluminum foil layer bonded to each of them and contains an absorbent layer carrying exothermic material. The exothermic material when the absorbent layer is properly wetted and the material is in contact with the foil is capable of providing heating intervals of several minutes duration with the exterior surfaces of the envelope at a temperature in the approximate range of 80° F. to 140° F. Each envelope has a multiplicity of apertures of pin prick dimensions distributed uniformly over its surfaces for the entry of sufficient water to wet the absorbent layer to the appropriate extent.

Such packages, when the absorbent layer was appropriately wetted and the package in the form of a roll and with tresses wound about it, enabled the tresses to be efficiently curled both by professionals and by individuals curling their own hair. Such packages are, however, relatively expensive to manufacture and the flexibility of the envelopes is restricted by the absorbent layers. In addition some difficulty is often experienced, at least initially, in moistening the absorbent layer to the appropriate extent and the exothermic material is relatively free within the envelope.

THE PRESENT INVENTION

The general objective of the present invention is to provide hair curling units that are less expensive to produce and are easier to use effectively than those hitherto available.

In accordance with the invention, this general objective is attained with units formed from a composite sheet, preferably in the form of a coiled strip, having one side aluminum foil and the other side paper. Each unit has two interconnected walls with their aluminum foil sides proximate and with the aluminum foil side of at least one of the walls provided with an exothermic coat which is a dehydrated coating of an aqueous solution of nitric acid and mercury which during drying has partly reacted with the aluminum foil so that the exothermic material is effectively bonded thereto.

In practice, the aluminum foil coating is a liquid the formula of which is nitric acid, approximately 9 parts; mercury, approximately 2.6 parts; and distilled water about 37.5 parts. When dehydrated, the exothermic coat is white and typically it is discontinuous. The exothermic material has not been subjected to chemical analysis.

Another objective of the invention is to ensure that little if any of the exothermic coat will dislodge and escape during the handling and use of the units while still permitting the exothermic to be easily moistened. This objective is attained by providing that opposite margins of one pair thereof of each unit are interconnected to hold the two walls together while enabling the two walls to be easily so separated as to enable the exothermic coat to be suitably moistened. A satisfactory unit may be formed from a blank of paper backed aluminum foil having its foil side provided with an exothermic coat in accordance with the invention with the blank so dimensioned that when folded along a central, transverse line to being the aluminum foil sides proximate to establish the two interconnected walls a unit of wanted dimensions is established, preferably with the margins opposite the fold also interconnected.

Yet another objective, however, is to ensure that the units may be readily formed utilizing rolls of paper backed aluminum foil in the form of strips of the wanted width without loss of the exothermic material when such strips have been coated and again wound into rolls, an objective attained with one wall derived from a strip from a first roll with its aluminum foil side coated and the other wall derived from a second like roll with its aluminum foil side underlying the coated aluminum foil side of the first roll and with the two strips wound together into a roll for use in forming the units by unwinding the last named roll, uniting the margins of the strips and severing the strip into unit-forming lengths.

Other objectives of the invention and the manner of their attainment will be apparent from the following description of the preferred embodiment and the appended claims.

In use, coated blanks of wanted dimensions for the units are provided and these are folded, foil side inward, to form the units. When the units are to be used, the exothermic coat is moistened and then used in various ways by forming them into rolls and winding tresses thereabout. The exterior paper surfaces of the units become heated to the appropriate extent and for the wanted duration to ensure the curling of the tresses.

BRIEF DESCRIPTION OF THE DRAWINGS

The accompanying drawings illustrate the production of units in accordance with a preferred embodiment of the invention and several ways in which such units may be used. In the drawings.

THE PREFERRED EMBODIMENT OF THE INVENTION

Hair curling units in accordance with the preferred embodiment of the invention are generally indicated at 10 and they may be best described in connection with their production in the manner illustrated by FIGS. 1 and 2.

Figure 1:
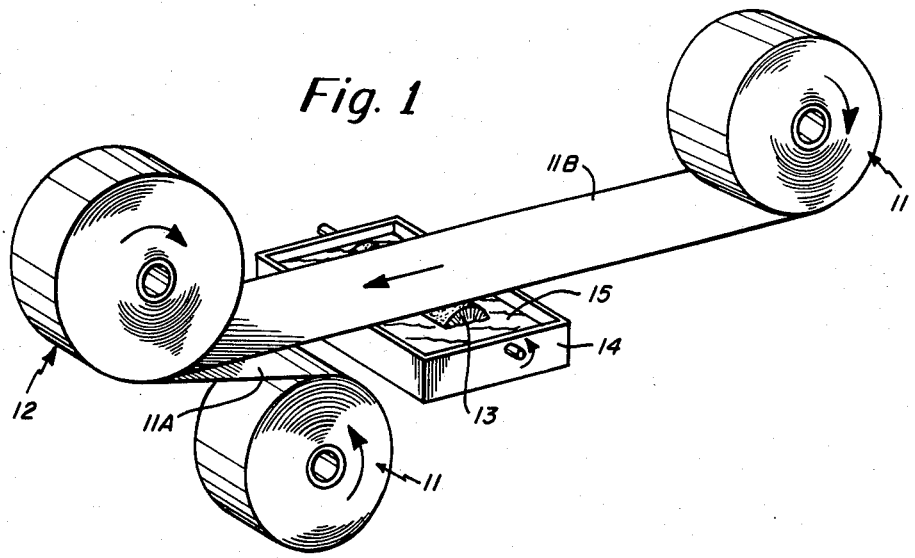
FIG. 1 is a schematic view illustrating the production of a cmposite strip having an internal exothermic coat.
Figure 2:
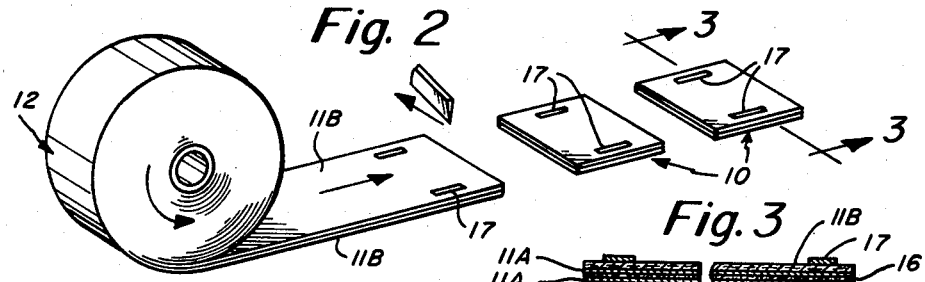
FIG. 2 is a like view illustrating the unwinding of the roll, the uniting of margins of the strip, and the severing of the strip to form the units.
Figure 3:
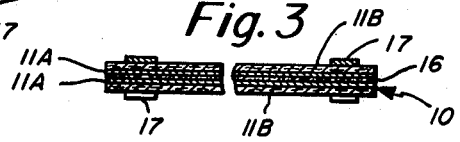
FIG. 3 is a fragmentary section, on a substantial increase in scale, taken approximately along the indicated line 3—3 of FIG. 2.

In FIG. 1, each of the upper and lower identical rolls 11 consists of a long flexible strip having an aluminum foil side 11A and a paper side 11B which is preferably water repellant. The two rolls 11 are shown as being unwound and rewound together to form a roll 12. Suitable rolls of such material are available commerically in a range of widths and thicknesses. A strip, by way of example, in the order of 0.05 inches in thickness and of a width in the two to three inch range is satisfactory.

The strip from the upper roll 11 has its aluminum foil side 11A positioned to engage a coating roll 13 as it is being rewound. The coating roll 13 is rotatably supported in a receptacle 14 for the liquid 15 which, when transferred to the aluminum foil side 11A and dried forms the exothermic coat 16. The lower roll is positioned so that the aluminum foil side 11A of its strip is disposed towards the coated side of the strip of the upper roll so that the aluminum foil sides 11A are brought into mutual contact with each other and the coat 16 as the roll 12 is formed. As the liquid partly reacts with the aluminum foil, the resulting heat expedites drying but under most conditions, the aluminum foil side 11A of the strip from the lower roll is but partly coated and it should be here noted that even on the strip from the upper roll, the coat 16 is usually discontinuous.

The units 10 are formed by unwinding the roll 12, uniting the sides of the strip by heat sealing or by staples 17, as two examples of means for so doing, and then cutting the united strips into the lengths wanted for the units 10, in the two to three inch range by way of preferred examples.

The liquid may be formed in gallon batches by mixing 900 grams of nitric acid (full strength, commercial grade) and 260 grams of mercury in one gallon of distilled water.

With the two walls of each unit marginally connected at each side, the exothermic material may be readily moistened from either end just prior to use.

Figure 4:
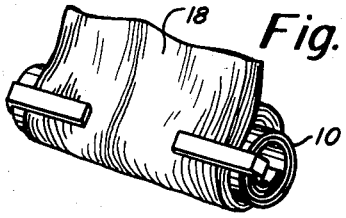
FIG. 4 is a view of a unit formed into a roll about which tresses are wound and to which the tresses are secured by means of a flexible wire-reinforced member.
Figure 5:
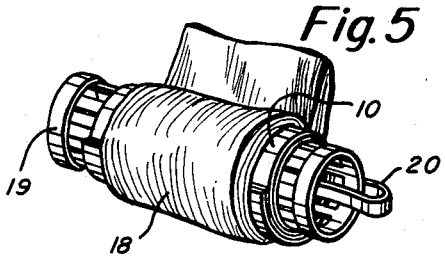
FIG. 5 is a similar view but with the unit wrapped around a core and the tresses and the unit secured to the core by means of a clip.
Figure 6:
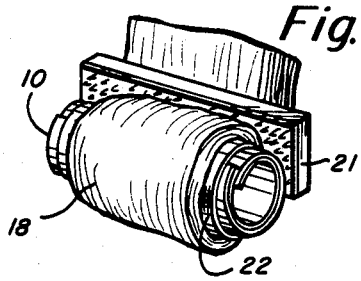
FIG. 6 is yet another similar view with a thin paper layer between the tresses and the unit and the assembly held together by a Velcro faced strip which also serves as a heat shield.

In one typical use, that illustrated by FIG. 4, a unit 10 is formed into a roll about which tresses 18 are wound and held in place thereon by means of a flexible and typically wire reinforced member 18 while in another type use, a unit 10 is wound about a core 19 and after tresses are wound about the unit 10, they and the unit may be connected and the core 19 by suitable means, in this case by a clip 20. In practice, once the exothermic coats 16 of the units 10 are moistened, the outer paper sides 11B become heated for several minutes within the approximate range of from 80° F. to 140° F. during which time, the tresses become curled.

In the event, the temperature is uncomfortable to the user, a Velcro coated strip 21 may be employed to shield the scalp with the Velcro holding the tresses. Should it be desired to modify the temperature to which the tresses are exposed, additional paper 22 may be wrapped about the unit 10.

Figure 7:
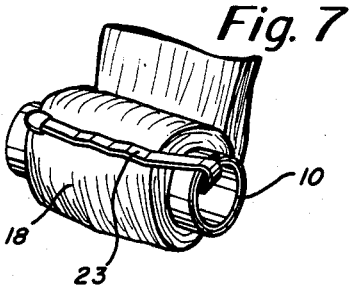
FIG. 7 is a somewhat similar view but with the unit formed into a roll about which tresses are wound and connected thereto by a bobbie pin.

A unit 10 may be formed into an unsupported roll as shown in FIG. 7 with a bobbie pin 23. The bobbie pin must be placed outwardly, as being metal, it becomes hot and must be held away from the scalp.

I claim:

1. A hair curling unit to be formed into a roll or to be wrapped about a member, in either case then to have tresses wound about it, said unit including two interconnected, rectangular walls of flexible composite sheet material having an aluminum foil side and a paper side, the aluminum foil sides the interior surfaces of the unit, the aluminul foil side of at least one wall provided with a dehydrated exothermic coat consisting of nitric acid and mercury partly reacted therewith and bonded thereto, and said walls having at least one disconnected side margin to facilitate the admittance of coat-moistening mositure whereby the exothermic coat is activated to heat the paper sides of the unit.

2. The hair curling unit of claim 1 in which the coat is discontinuous.

3. The hair curling unit of claim 1 in which the aluminum foil sides of both walls are provided with said dehydrated exothermic coat.

4. The hair curling unit of claim 1 in which opposite side margins are disconnected.

5. The hair curling unit of claim 1 in which the walls are separate sections of said material and are approximately the same size and shape, one section overlying the other, and means uniting said sections along at least one of their margins.

6. The hair curling unit of claim 5 in which means unite said sections along one pair of opposite margins.

* * * * *